US008607707B1

(12) United States Patent
Arnon et al.

(10) Patent No.: US 8,607,707 B1
(45) Date of Patent: Dec. 17, 2013

(54) IDENTIFIABLE AMMUNITION AND RELATED METHODS

(76) Inventors: Harry Arnon, Longwood, FL (US); Josef Arnon, Longwood, FL (US); Neil Murray, Orlando, FL (US)

( * ) Notice: Subject to any disclaimer, the term of this patent is extended or adjusted under 35 U.S.C. 154(b) by 22 days.

(21) Appl. No.: 13/360,859

(22) Filed: Jan. 30, 2012

Related U.S. Application Data

(60) Provisional application No. 61/462,291, filed on Jan. 31, 2011.

(51) Int. Cl.
*F42B 30/02* (2006.01)

(52) U.S. Cl.
USPC ..... 102/439; 102/501; 102/517; 102/293

(58) Field of Classification Search
USPC ..... 102/439, 444, 501, 502, 509, 510, 513, 102/516, 517, 529, 293
See application file for complete search history.

(56) References Cited

U.S. PATENT DOCUMENTS

| | | | | | |
|---|---|---|---|---|---|
| 1,023,469 | A | | 4/1912 | Haslett | |
| 1,650,908 | A | * | 11/1927 | Ramsey | 42/106 |
| 1,887,324 | A | * | 11/1932 | Pocoroba | 40/629 |
| 2,592,434 | A | * | 4/1952 | Krasnow | 102/513 |
| 4,150,624 | A | * | 4/1979 | Hammond | 102/293 |
| 4,485,742 | A | | 12/1984 | Mamo | |
| 5,485,789 | A | * | 1/1996 | Collier | 102/501 |
| 5,511,483 | A | * | 4/1996 | Griffin, Jr. | 102/501 |
| 5,646,365 | A | | 7/1997 | Collier | |
| 5,698,816 | A | * | 12/1997 | Roxby | 102/516 |
| 6,293,204 | B1 | * | 9/2001 | Regen | 102/430 |
| 7,143,697 | B2 | * | 12/2006 | Mace et al. | 102/430 |
| 7,207,272 | B2 | * | 4/2007 | Kinoshita | 102/430 |
| 7,240,619 | B2 | * | 7/2007 | Kinoshita | 102/430 |
| 7,533,614 | B1 | * | 5/2009 | Reich | 102/430 |
| 8,161,885 | B1 | * | 4/2012 | Emary | 102/506 |
| 8,402,896 | B1 | * | 3/2013 | Hollerman et al. | 102/513 |
| 2006/0213105 | A1 | * | 9/2006 | Cugliari | 42/1.01 |

* cited by examiner

*Primary Examiner* — James Bergin
(74) *Attorney, Agent, or Firm* — Allen, Dyer et al.

(57) ABSTRACT

The invention relates to an identifiable bullet and methods for making an identifiable bullet. In one embodiment, the bullet has a generally circumferential body that tapers from a rearward end toward a forward end. A generally circumferential bore extends from an orifice on the forward end into the body at least part of the way between the forward end and the rearward end. The end of the bore opposite the orifice includes a polymeric material support surface. A polymeric material is placed between the polymeric material support surface and the forward end. The polymeric material may include a user identifiable marker for allowing a user to identify the bullet when viewing the forward end. Alternatively, the polymeric material may cover a user identifiable marker and seal the user identifiable marker in the bore. A user may identify the bullet by viewing the marker from the forward end of the bullet.

19 Claims, 2 Drawing Sheets

IDENTIFIABLE AMMUNITION AND RELATED METHODS

CROSS-REFERENCE TO RELATED APPLICATION

This application claims the benefit of Provisional Application Ser. No. 61/462,291 filed Jan. 31, 2011, titled "Polymer Tip Identification," the contents of which are incorporated herein by reference in their entirety.

FIELD OF THE INVENTION

The present invention relates to the field of ammunition, and, more particularly, to ammunition that includes a user identifiable mark located at a bore on the bullet for allowing a user to distinguish the marked ammunition from other similar looking ammunition.

BACKGROUND

Rifle and handgun cartridges are shaped to be fired from a firearm that has a specific caliber. Because of this, the shape of the cartridges do not vary by manufacturer; instead, cartridges that are intended to be used with a specific caliber handgun generally look exactly the same regardless of the manufacturer. Cartridge manufacturers often remedy this by stamping their names onto the bottom of the cartridge case to allow users to distinguish one brand from another.

Aside from the manufacturer, a user may wish to identify ammunition according to other categories such as, for example, training rounds, live rounds, or caliber among others. The conventional approaches to ammunition identification are to either etch a mark into the exterior of the bullet or to "paint the tip" of the bullet using paint or another suitable marking material. Unfortunately, these techniques suffer from one or more of the following drawbacks: poor adherence of marking material to the bullet, inconsistent adherence of the marking material to the bullet, distorting the weight distribution of the bullet, affecting the ballistic performance of the bullet, affecting the firing trajectory of the bullet, or affecting the ease of loading.

SUMMARY

An aspect of the invention is directed to a user identifiable bullet that has a bore in the forward end of the bullet. A user identifiable marker is located in the bore and is sealed in place with a substantially transparent polymeric material. The user is capable of easily identifying the ammunition by viewing the marker. In a preferred embodiment, the weight of the marker and polymeric material are evenly distributed about the axis of the bullet to minimize any effects to the bullet's firing trajectory.

In a particular embodiment, the bullet has a generally circumferential body that tapers from a rearward end toward a forward end. A generally circumferential bore extends from an orifice on the forward end into the body at least part of the way between the forward end and the rearward end. The end of the bore opposite the orifice includes a polymeric material support surface. The polymeric material may include a user identifiable marker for allowing a user to identify the bullet when viewing the forward end. In a preferred embodiment, the polymeric material is placed between the polymeric material support surface and the forward end. "The internal portion of the bullet with the hole is filled with the polymeric material." Such a bullet may also comprise a case surrounding the rearward end and stopping short of the forward end.

In certain embodiments, the bullet may further comprise one or more of the following features: a generally circumferential body located about a circumferential axis that passes through the bullet, the center of the generally circumferential bore being on the axis; the polymeric material support surface may be generally parallel to the surface surrounding the orifice; the marker may be a disk located in the bore and covered with the polymeric material; the user identifiable mark may be located on the marker; the marker may include a top surface facing the orifice with the mark being located on the top surface; and the polymeric material may extend outside of the orifice to form a rounded tip on the forward end of the bullet In an embodiment of a method aspect of the invention, an identifiable bullet may be made by obtaining a projectile portion having a generally circumferential body tapering from a rearward end toward a forward end; forming a generally circumferential bore in the projectile portion, the generally circumferential bore extending from the forward end into the body at least part of the way between the forward end and the rearward end; placing a marker for allowing a user to identify the bullet in the bore; inserting a flowable polymeric material into the bore; and hardening the polymeric material to provide a substantially transparent window through which the marker can be viewed by a user for identifying the bullet.

These and other aspects and advantages of the present invention will be better appreciated in view of the attached drawings and the following description of certain preferred embodiments.

DESCRIPTION OF CERTAIN PREFERRED EMBODIMENTS

In the Summary of the Invention above and in the Description of Certain Preferred Embodiments, reference is made to particular features (including method steps) of the invention. It is to be understood that the disclosure of the invention in this specification includes all possible combinations of such particular features, regardless of whether a combination is explicitly described. For example, where a particular feature is disclosed in the context of a particular aspect or embodiment of the invention, that feature can also be used, to the extent possible, in combination with and/or in the context of other particular aspects and embodiments of the invention, and in the invention generally.

The term "comprises" is used herein to mean that other features or steps are optionally present. When reference is made herein to a method comprising two or more defined steps, the steps can be carried in any order or simultaneously (except where the context excludes that possibility), and the method can include one or more steps which are carried out before any of the defined steps, between two of the defined steps, or after all of the defined steps (except where the context excludes that possibility).

This invention may be embodied in many different forms and should not be construed as limited to the embodiments set forth herein. Rather, these embodiments are provided so that this disclosure will be thorough and complete, and will convey the scope of the invention to those skilled in the art.

Embodiments of the invention are described herein in connection with conventional ammunition cartridges such as those that can be fired from a rifle or handgun. In this context, the drawings illustrate these embodiments by showing small caliber ammunition cartridges. It is to be understood, however, that the invention is not limited to the specific size or shape ammunition cartridge that is described. The invention may be adapted as desired for use with any size or shape ammunition cartridge, including different caliber cartridges.

Figure 1:
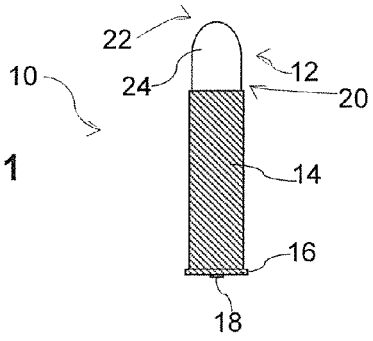
FIG. 1 is a side elevation view of an example of conventional ammunition.

Referring to FIG. 1, a conventional cartridge 10 includes a bullet 12 held partially within a bullet case 14 that contains a propellant for ejecting the bullet 12 from the bullet case 14 when the cartridge 10 is fired. The cartridge 10 also includes a rim 16 opposite the bullet 12. The rim 16 typically houses the cartridge's 10 firing pin 18, which, when the cartridge is fired, ignites the primer which, in turn, ignites the propellant.

The bullet 12 is the projectile portion of the cartridge 10. The bullet 12 has a generally circumferential body 24 that tapers inwardly from a rearward end 20 which contacts the case 14 towards a forward end 22. The bullet 12 is typically made of a core of lead or other metal and may or may not include a metallic jacket surrounding the core.

In accordance with the invention, an individual bullet 12, or a cartridge 10, is made identifiable and distinguishable from other bullets or cartridges by placing a user identifiable marker on the bullet 12. The marker may be made user identifiable by placing a mark such as one or more letters, words, numbers, symbols, designs, logos or the like on the marker. In certain examples the mark is identifiable by the user as the manufacturer of the bullet or cartridge. Accordingly, the mark may include the manufacturer's name or other source identifying feature such as the manufacturer's trademark. In other examples, the mark may include a color that the user would associate with a particular meaning, such as a manufacturer or caliber of the bullet, for example. In yet another example, the mark includes the caliber of the bullet in number format. These are just a few of the many possible user identifiable marks that may be used in the invention.

Figure 2:
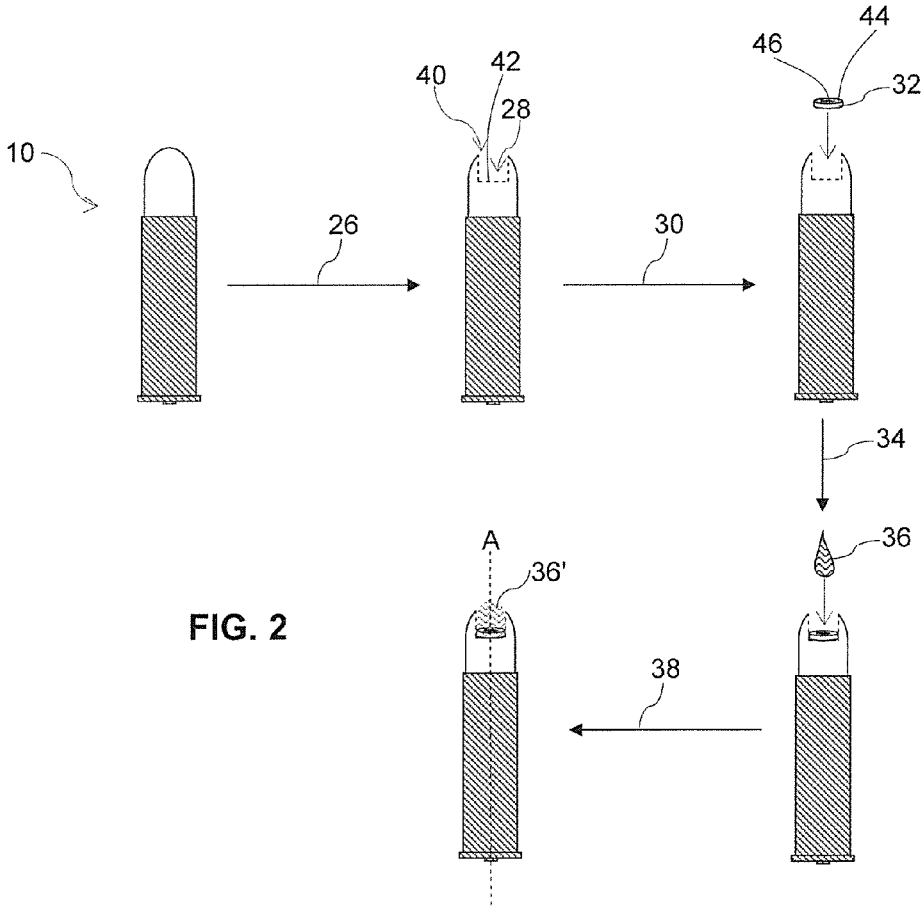
FIG. 2 is a flowchart showing several side elevation views of the ammunition of FIG. 1 being made identifiable in accordance with an aspect of the invention.

With reference to FIG. 2, a method aspect of the invention will now be described. A method of making user identifiable bullet comprises forming 26 a bore 28 in the bullet 12, placing 30 a marker 32 in the bore 28, introducing 34 a flowable polymeric material 36 into the bore, and hardening 38 the polymeric material. This method aspect will now described in more detail with continuous reference to FIGS. 1 and 2.

In a preferred embodiment, the bore 28 is formed by drilling, casting, or molding a hole in the bullet 12 from the forward end 22 toward the rearward end 20. The bore 28 is preferably generally circumferential with the center of the bore 28 being aligned along an axis A that passes through the circumferential body of the bullet 12. The bore 28 forms an orifice 40 at the bullet's 12 forward end 22 and extends into the bullet 12 at least part of the way between the forward end 22 and rearward end 20. Inside the bullet 12, the bore 28 terminates at a support surface 42. The support surface 42 may be made substantially flat and parallel to the radial direction of the orifice 40 if desired The marker 32 is preferably a disk shaped object that includes a top surface 44 where the mark 46 is located. The marker 32 is placed above the support surface 42 with the mark 46 facing the orifice 40. The marker 32 may be made of paper, plastic, metal or any other suitable material. In some embodiments, the marker 32 is a material that may be engraved mechanically or with a laser. In a particular embodiment, the marker 32 is made of paper and the mark 46 is printed thereon. The mark 46 may alternatively be mechanically engraved or laser engraved on the marker 42. In many cases it may be advantageous to minimize the weight of the marker 32 so that the marker 32 does not affect the trajectory of the bullet 12 when it is fired. It is preferred that the weight of the marker 32 is distributed evenly about the axis A.

The polymeric material 36 is preferably introduced 34 into the bore 28 when the polymeric material 36 is in a flowable form, such as a viscous liquid. This advantageously allows the polymeric material 36 to uniformly fill the bore 28 so that the weight of the polymeric material 36 is evenly distributed about the axis A to prevent the polymeric material from substantially affecting the trajectory of the bullet 12 when fired. The polymeric material 36 may be introduced manually, such as by pouring, rubbing, or injecting it into the bore 28 or introduced via an automated process.

Hardening the polymeric material 36 into a hardened polymeric material 36' may be achieved by exposing the flowable polymeric material 36 to a hardener. The hardened polymeric material 36' forms a substantially transparent sealant for securing the marker 32 in the bore 28. In a particularly preferred embodiment, the polymeric material 36 is an adhesive that cures or hardens when exposed to ultraviolet radiation. Suitable UV curable polymeric materials include, but are not limited to, acrylate, methacrylate, epoxy, urethane, rubber, or combinations thereof. The UV curing process may either be performed manually by using a hand held UV curing light or using an automated process in which the polymeric material and curing process are performed in the same mechanized production line. Aside from UV curable polymeric materials, other types of polymeric materials such as epoxy resins may alternatively be used. It is preferred that the hardened polymeric material 36' is substantially transparent so that a user, when viewing the bullet 12 from the forward end 22, can see the mark 46 through the polymeric material 36. The hardened polymeric material 36' may extend outside of the bore 28 to form a rounded tip on the forward end 22 of the bullet 12.

Figure 3:
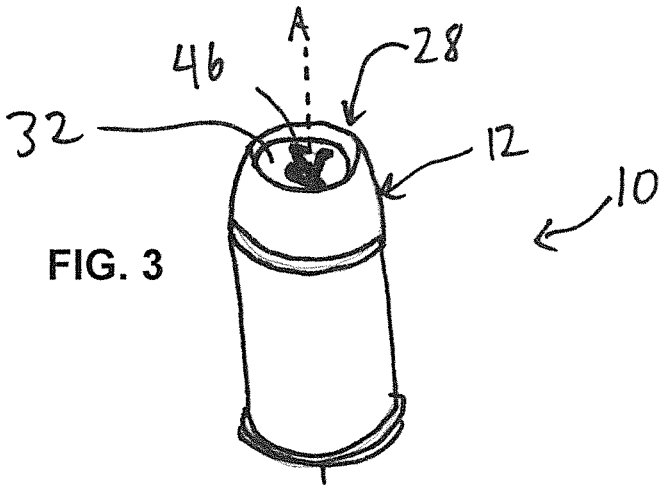
FIG. 3 is a side perspective view of identifiable ammunition before the polymeric material is introduced.
Figure 4:
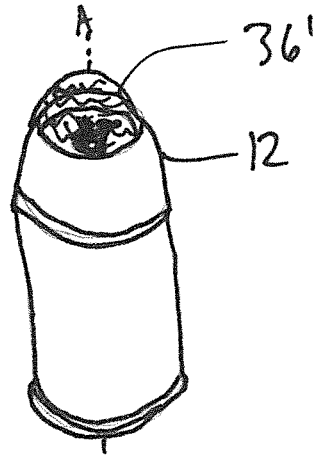
FIG. 4 is a side perspective view of the identifiable ammunition of FIG. 3, after the polymeric material has been introduced.
Figure 5:
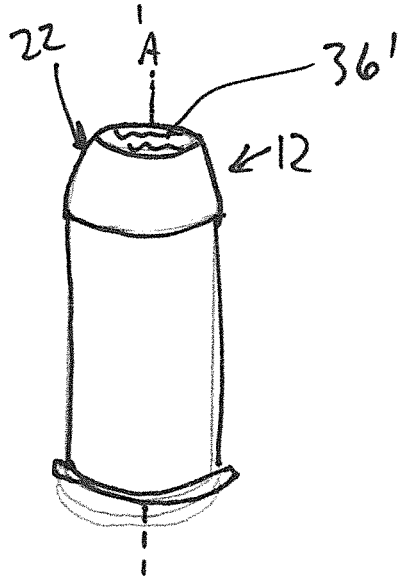
FIG. 5 is a side elevation view of identifiable ammunition after the polymeric material has been introduced.

Now, referring to FIGS. 3-5, an exemplary cartridge 10 that includes a user identifiable bullet 12 is shown. In FIG. 3, the bullet 12 includes a bore 28 with a marker 32 located therein. The mark 48 in this example is the letter R. In FIG. 4, the cartridge 10 of FIG. 3 is shown including the hardened polymeric material 36'. The marker 32 is located in the bore 28 beneath the hardened polymeric material 36'. The mark 48 is viewable from the forward end 22 of the bullet 12 through the hardened polymeric material 36'. In FIG. 4, the hardened polymeric material 36' forms a rounded tip on the forward end 22 of the bullet 12.

The present invention has been described hereinabove with reference to the accompanying drawings, in which preferred embodiments of the invention are shown. Unless otherwise defined, all technical used herein are intended to have the same meaning as commonly understood in the art to which this invention pertains and at the time of its filing. Although various methods and materials similar or equivalent to those described herein can be used in the practice or testing of the present invention, only some of the suitable methods and materials are described. The skilled should understand that the methods and materials used and described are examples and may not be the only ones suitable for use in the invention.

Accordingly, this invention may be embodied in many different forms and should not be construed as limited to the illustrated embodiments set forth herein. Rather, these illustrated embodiments are provided so that this disclosure will be thorough, complete, and will fully convey the scope of the invention to those skilled in the art. Therefore, in the specification set forth above there have been disclosed typical preferred embodiments of the invention, and although specific terms are employed, the terms are used in a descriptive sense only and not for purposes of limitation. The invention has been described in some detail, but it will be apparent that various modifications and changes can be made within the spirit and scope of the invention as described in the foregoing specification and as defined in the appended claims.

Any element in a claim that does not explicitly state "means for" performing a specified function, or "step for" performing a specified function, is not to be interpreted as a "means" or "step" clause as specified in 35 U.S.C. §112, ¶ 6. In particular, the use of "step of" in the claims herein is not intended to invoke the provisions of 35 U.S.C. §112, ¶ 6.

That which is claimed is:

1. A round of ammunition comprising:

a projectile portion having a generally circumferential body tapering from a rearward end toward a forward end;

a generally circumferential bore extending from an orifice at the forward end into the body at least part of the way between the forward end and the rearward end;

a marker support surface at an end of the bore opposite the orifice;

a marker adjacent to the marker support surface for allowing a user to identify the bullet and;

a substantially transparent sealant material between the marker and the forward end for securing the marker in the bore and allowing a user to view the marker through the sealant material from the forward end.

2. The round of ammunition of claim 1, further comprising a bullet case surrounding the rearward end and stopping short of the forward end and a propellant within the bullet case for propelling the projectile portion when the round of ammunition is fired.

3. The round of ammunition of claim 1, wherein the generally circumferential body is located about a circumferential axis and a center of the generally circumferential bore is on the axis.

4. The round of ammunition of claim 1, wherein the marker support surface is parallel to the surface surrounding the orifice.

5. The round of ammunition of claim 1, wherein the marker is generally disk shaped.

6. The round of ammunition of claim 1, wherein the marker includes a top surface facing the orifice and a user identifiable mark is on the top surface.

7. The round of ammunition of claim 1, wherein the substantially transparent sealant material is a flowable liquid that may be hardened by curing.

8. The round of ammunition of claim 1, wherein the substantially transparent sealant material extends outside of the orifice to form a rounded tip on the forward end.

9. A round of ammunition comprising:

a projectile portion having a generally circumferential body tapering from a rearward end toward a forward end;

a generally circumferential bore extending from an orifice at the forward end into the body at least part of the way between the forward end and the rearward end;

a polymeric material support surface at the end of the bore opposite the orifice;

a polymeric material between the polymeric material support surface and the forward end, the polymeric material including a user identifiable marker for allowing a user to identify the projectile portion when viewing the forward end.

10. The round of ammunition of claim 9, further comprising a bullet case surrounding the rearward end and stopping short of the forward end and a propellant within the bullet case for propelling the projectile portion when the round of ammunition is fired.

11. The round of ammunition of claim 9, wherein the generally circumferential body is located about a circumferential axis and a center of the generally circumferential bore is on the axis.

12. The round of ammunition of claim 9, wherein the polymeric material support surface is generally parallel to the surface surrounding the orifice.

13. The round of ammunition of claim 9, wherein the user identifiable marker is a disk located in the bore and covered with the polymeric material.

14. The round of ammunition of claim 13, wherein the user identifiable marker includes a top surface facing the orifice and a user identifiable mark is on the top surface.

15. The round of ammunition of claim 9, wherein the polymeric material is a flowable liquid that may be hardened by curing.

16. The round of ammunition of claim 9, wherein the polymeric material extends outside of the orifice to form a rounded tip on the forward end.

17. A method of making an identifiable round of ammunition, the method comprising:

obtaining a projectile portion having a generally circumferential body tapering from a rearward end toward a forward end;

forming a generally circumferential bore in the projectile portion, the generally circumferential bore extending from the forward end into the body at least part of the way between the forward end and the rearward end;

placing a marker for allowing a user to identify the round of ammunition in the bore;

inserting a flowable polymeric material into the bore; and hardening the flowable polymeric material to provide a substantially transparent window through which the marker can be viewed by a user from the forward end.

18. The method of claim 17, wherein hardening comprises exposing the polymeric material to ultraviolet radiation.

19. The method of claim 17, wherein the hardened polymeric material extends out of the bore and forms a rounded tip on the forward end.

* * * * *